US006126763A

United States Patent [19]

Williams et al.

[11] Patent Number: 6,126,763

[45] Date of Patent: Oct. 3, 2000

[54] MINIMUM SMOKE PROPELLANT COMPOSITION

[75] Inventors: Edna M. Williams, Chester Gap; Mark Friedlander, Centreville, both of Va.

[73] Assignee: Atlantic Research Corporation, Gainesville, Va.

[21] Appl. No.: 09/201,790

[22] Filed: Dec. 1, 1998

[51] Int. Cl.[7] ..... C06B 45/10; C06B 25/34; C06B 25/18; D03D 23/00

[52] U.S. Cl. ..... 149/19.5; 149/96; 149/92; 149/109.6

[58] Field of Search ..... 149/96, 19.8, 19.4, 149/19.5, 37

[56] References Cited

U.S. PATENT DOCUMENTS

| | | | |
|---|---|---|---|
| 2,945,751 | 7/1960 | O'Neill | 52/30 |
| 2,990,683 | 7/1961 | Walden | 60/35.6 |
| 3,297,503 | 1/1967 | Hoffmann | 149/39 |
| 3,639,183 | 2/1972 | Crescenzo et al. | 149/18 |
| 3,711,343 | 1/1973 | Dunigan | 149/2 |
| 3,808,061 | 4/1974 | Pierce | 149/18 |
| 3,867,215 | 2/1975 | Zucker et al. | 149/100 |
| 3,894,894 | 7/1975 | Elrick | 149/19 |
| 3,960,621 | 6/1976 | Whitworth et al. | 149/65 |
| 4,014,720 | 3/1977 | Wells | 149/19.8 |
| 4,298,411 | 11/1981 | Godsey | 149/19.4 |
| 4,389,263 | 6/1983 | Allen | 149/11 |
| 4,408,534 | 10/1983 | Araki et al. | 102/288 |
| 4,938,813 | 7/1990 | Eisele et al. | 149/19.2 |
| 5,372,664 | 12/1994 | Neidert et al. | 149/19.8 |
| 5,468,311 | 11/1995 | Godsey et al. | 149/19.4 |
| 5,520,756 | 5/1996 | Zeigler | 149/19.8 |
| 5,587,428 | 12/1996 | Jones et al. | 525/165 |
| 5,589,661 | 12/1996 | Menke et al. | 149/19.4 |

*Primary Examiner*—Charles T. Jordan
*Assistant Examiner*—Aileen J. Baker
*Attorney, Agent, or Firm*—Nixon & Vanderhye P.C.

[57] ABSTRACT

A high-performance minimum smoke propellant composition comprising an oxidizer and a lead salt which reduces the amount of smoke produced and enables the composition to sustain combustion at low pressure. The propellant is useful for various purposes, such as propelling man-rated, shoulder-launched rockets.

19 Claims, No Drawings

MINIMUM SMOKE PROPELLANT COMPOSITION

TECHNICAL FIELD

The present invention relates to a propellant composition which produces a minimum amount of smoke. The present invention is useful for propelling man-rated, shoulder-launched rockets such as those for anti-tank missile applications.

BACKGROUND ART

The present invention relates generally to propellant compositions which produce a minimum amount of smoke. Propellants are chemical compounds or mixtures thereof which, upon ignition, generate large volumes of hot gases at controlled, predetermined rates. Propellants serve as a convenient, compact form of storing relatively large amounts of energy for rapid release and enjoy utility in various industrial and military applications. Thus, propellants are generally employed in various situations requiring a readily controllable source of energy, as for ballistic applications, e.g., for periods of time ranging from milliseconds in weapons to seconds in rocketry, wherein the generated gases function as a working fluid for propelling projectiles such as rockets and missile systems.

In use, a propellant grain is typically placed within the interior of the case of a rocket motor. The propellant forming the grain is combusted to provide a thrust within the interior of the rocket motor case. The rocket motor derives its propellant thrust from the formation of the hot generated gases through the throat and nozzle of the motor case. Solid propellants are also employed extensively in the aerospace industry. Solid propellants have developed as the preferred method of powering most missiles and rockets for military, commercial, and space applications, because they are relatively simple and economic to manufacture and use, and they have excellent performance characteristics and are very reliable.

Different propellant applications, however, may impose a peculiar requirement on the propellant composition linked to a particular utility. There are several applications in which the rocket motor is required to perform with minimal or no smoke output. For example, in tactical rocket motors, the production of smoke is disadvantageous, particularly in shoulder-launched rockets, wherein generated smoke may obscure the user's vision and toxic components entrained in the smoke may even cause short and/or long-term adverse effects, such as eye damage. In addition, tactical rockets launched from an aircraft or vehicle will also require minimal or no generated smoke which may obscure the vision of a pilot or vehicle operator. Moreover, the production of smoke facilitates tracking the source of the launched rocket by enemy forces, particularly when used in an anti-tank capacity, a serious disadvantage during military operations.

An important consideration in solid propellants, including minimum smoke propellants, is the provision of satisfactory energy output and burn rate of the propellant, without significantly adding to the smoke output of the propellant. It is important that the amount of energy delivered meet system performance requirements and space available, and that the propellant burn at a controlled and predictable rate. If a satisfactory burn rate of the propellant can be obtained, it is possible to assure proper operation of the rocket motor, or other similar device. If the propellant achieves an excessively high burn rate, the pressure created within the casing may exceed the design capability of the casing, resulting in damage or destruction to the device. If the propellant does not develop a sufficient burn rate, there may not be sufficient thrust to propel the rocket motor over the desired course.

In addition to energy and burning rate considerations, a propellant must meet other criteria including mechanical characteristics, stability, sensitivity, cost of manufacture, and uniformity of performance for optimal effectiveness. Other factors affecting propellant selection for guns and rockets, include manufacturing characteristics, such as the availability and cost of raw materials and processing equipment, simplicity and cost of manufacture and inspection, manufacturing hazards, and propellant viscosity and flowability; energy delivery requirements, such as specific impulse or force, loading density in terms of required burning characteristics, metal parts requirements in terms of operating pressure over a required temperature range; temperature dependance such as ignition, pressure, burning rate and thrust characteristics over temperature range; mechanical characteristics over temperature range; effect of high-low temperature cycling; reliability of performance including lot-to-lot variations in burning rate and pressure, effect of small variations in metal parts on performance, and effect of small variations in composition and dimensions on performance; long-term storage characteristics such as deformation changes, performance changes, moisture absorption, and exudation or migration of plasticizer; effects of mechanical characteristics, such as long-term storage, high-low temperature cycling, acceleration forces, rough handling and case bonding; compatibility with process equipment, with personnel (toxicity), with metal and plastic parts and other components, of reaction products with personnel, metal parts, and electronic equipment and erosive effects of reaction products; and system requirements such as smokeless exhaust, combustion stability, effect of exhaust plume on radar, absence of ignition peaks or reinforcing pressure waves, minimum gun smoke, flash and blast pressure, and detonation free in event of malfunction.

Another significant concern in the formulation of propellants is safety, because propellants are often employed or stored in an area in which other military ordinance is stored, and employed in environments which are conductive to accidental ignition, e.g., stray bullets or flying debris. Moreover, propellants must be formulated to avoid premature ignition by virtue of exposure to hot environments or under normal operating conditions. Thus, an important factor in formulating a propellant is insensitivity to premature or accidental ignition.

In addition, rocket propellants desirably exhibit adequate mechanical properties to withstand the stresses imposed during handling and firing. In many situations, rocket propellants must be capable of performing satisfactorily after undergoing thermal stresses produced during long-term exposure and cycling at extreme temperatures. In view of the recognized criticality of failure of a single grain in a rocket, rocket grains are subjected to a large number of tests and inspections to ensure that they satisfy certain minimum mechanical and physical characteristics. Well-established laboratory methods determine the tensile strengths, the modulus in tension and compression, elongation under tension, and deformation under compression of rocket propellants.

It has been found extremely difficult to formulate an effective rocket propellant which, upon combustion, generates a minimum or no amount of smoke and attendant particles while at the same time satisfies other requisite properties such as energy output, burn rate, insensitivity to accidental or premature ignition, ability to withstand long term storage and environmental stresses while meeting the broad range of military, industrial and research requirements. For example, ammonium perchlorate, a conventional oxidizer, cannot be used in minimum smoke propellant compositions because its presence results in the production of noxious gases that are toxic in man-rated environments. Moreover, propellant compositions are typically compacted into the form of grains of a suitable shape. Such propellant grains must be capable of sustaining thermal and tensile shock during igniter functioning, and must exhibit sufficient strength to remain intact during gas generator functioning if ballistic performance is to remain unaffected. The grains must retain such capability after aging and cycling.

Accordingly, there exists a continuing need for minimum smoke producing propellant compositions, particularly minimum smoke propellant compositions for man-rated, shoulder-launched rockets, which exhibit optimal ballistic properties.

DISCLOSURE OF THE INVENTION

An object of the invention is an effective gas generating composition with minimal smoke generation.

Another object of the present invention is an effective gas generating composition for a rocket propellant which exhibits minimal smoke generation while exhibiting the requisite mechanical and physical properties for rocket propellant utility.

According to the present invention, the foregoing and other objects are achieved in part by a gas generating composition comprising a nitramine and a non-toxic metal oxide.

According to the present invention, the foregoing and other objects are achieved in part by a method for propelling a projectile comprising the step of igniting a gas generating composition, which composition comprises an oxidizer and a lead salt.

Additional objects and advantages of the present invention will become readily apparent to those skilled in this art from the following detailed description, wherein only the preferred embodiment of the invention is described, simply by way of illustration of the best mode contemplated for carrying out the invention. As will be realized, the invention is capable of other and different embodiments, and its several details are capable of modifications in various obvious respects, all without departing from the invention. Accordingly, the description is to be regarded as illustrative in nature, and not as restrictive.

SUMMARY OF THE INVENTION

The present invention provides a gas generating composition which yields minimal smoke upon combustion. In addition, the inventive gas generating composition satisfies the rigid requirement for rocket propellant utility, particularly in military applications, as in the launching of anti-tank missiles. The propellant composition of the present invention not only exhibits minimum smoke generation and minimal generation of noxious vapors and particles, but also exhibits excellent mechanical properties, satisfactory energy output and a satisfactory burn rate. In addition, the rocket propellant compositions, according to the present invention, are relatively insensitive to accidental ignition and are capable of withstanding long term storage and environmental stresses. Thus, the compositions of the present invention may be used in a variety of military, industrial and research applications.

The propellant compositions may also comprise an oxidizer and a lead salt, preferably lead citrate and one or more plasticizers. Suitable plasticizers include nitrate esters, such as 1,2,4-butanetriotrinitrate (BTTN) and diethyleneglycol dinitrate (DEGDN). The plasticizer(s) may be present in a range of from about 15% to about 40%, such as from about 20% to about 30%, for example, from about 23% to about 28%. Unless otherwise stated, all percentages set forth herein are by weight.

The propellant compositions of the present invention may also comprise one or more binders. Suitable binders include nitrocellulose (NC) binders and polyesters such as caprolactone polyol (PCP) and polyglycol adipate (PGA). A preferred binder blend is NC, PCP, PGA. The binder blend may be present in a range of from about 1% to about 8%, such as from about 2% to about 6%, for example, from about 3.5% to about 4.5%.

The propellant compositions of the present invention may also comprise one or more stabilizers, such as nitrate ester stabilizers, and may also include combustion (ballistic) stabilizers. A suitable nitrate ester stabilizer is N-methylnitroaniline (MNA). Suitable combustion (ballistic) stabilizers include carbon and zirconium carbide. The nitrate ester stabilizer may be present in an amount about 0.1% to about 3%, for example, from about 0.75% to about 1.5%. The combustion (ballistic) stabilizers may be present in an amount about _0.1% to about 5%, such as from about 0.75% to about 3%, for example, from about 1.5% to about 2.0%.

The inventive propellant compositions comprise one or more oxidizers. Suitable oxidizers include nitramine compounds such as cyclotrimethylenetrinitramine (RDX) and cyclotetramethylenetrinitramine (HMX). The oxidizer may be present in an amount of about 50% to about 75%, such as from about 52% to about 65%, for example, from about 60% to about 63%.

The propellant compositions of the present invention further comprise one or more lead salts which may include lead citrate and lead oxide. The lead salt may be present in a range of from about 0.1% to about 7%, such as from about 1% to about 5%, for example, from about 2.0% to about 3%. The lead salt is combined with the carbon and a small amount of polyglycol adipate to form a paste material. This process improves dispersion of the salt. The propellant compositions of the present invention may further comprise one or more curatives, such as hexamethylene diisocyanate (HMDI), isophorone diisocyanate (IPDI) and aliphatic polyisocyanate resins based on HMDI (e.g., DESMODUR N-3200, Bayer Corporation, hereinafter sometimes referenced as "N-3200 curative"). The curative may be present in an amount of about 0.1% to about 4%, such as from about 0.3% to about 3%, for example, from about 1.0% to about 2%.

Other additives conventionally employed in gas generating compositions can also be incorporated, provided they are not inconsistent with the objectives of the present invention.

EXAMPLES

A minimum smoke propellant was formulated as follows:

BTTN, 17–20%

DEGDN, 6.0–8.0%

NC, 3.5–4.5%

MNA, 0.75–1.5%

RDX, 60–63%

Lead citrate, 2–7%, 1.5–3.0%

Carbon, 0.4–1.0%

Zirconium carbide, 0.9–1.1%

N-3200 curative, 1.0–2.0%

The propellant has a higher than typical burning rate for minimum-smoke propellants, with a low pressure exponent, and sustains combustion as low as 100 psi.

| | |
|---|---|
| Burning rate at: | 300 psi = 0.33 in/sec.<br>500 psi = 0.40 in/sec.<br>1000 psi = 0.53 in/sec<br>1500 psi = 0.59 in/sec. |

Pressure exponent 0.32

Also, the propellant has excellent mechanical properties, with good low temperature strain properties.

| Temp. ° F. | Max Stress, psi | Max Strain, % | Modulus, psi |
|---|---|---|---|
| 145 | 51 | 21 | 334 |
| 70 | 94 | 26 | 483 |
| −45 | 456 | 14 | 10171 |

The propellant compositions in accordance with the present invention are useful in various military, industrial and scientific applications where gas generation is desired, such as the launching of rockets, particularly anti-tank missiles, wherein minimal smoke and noxious products are generated. The gas propellant compositions in accordance with the present invention exhibit excellent mechanical properties, satisfactory energy output and burn rate, relative insensitivity to accidental or premature ignition, and can withstand long term storage and environmental stresses.

Only the preferred embodiments of the invention and examples of its versatility are described in the present disclosure. It is to be understood that the invention is capable of use in various other combinations and environments and is capable of changes or modifications within the scope of the inventive concept as expressed herein.

What is claimed is:

1. A minimum smoke gas generating propellant composition comprising:

an oxidizer;

a lead salt;

a plasticizer blend;

a binder which includes a polyester selected from the group consisting of caprolactone polyol and polyglycol adipate;

a stabilizer;

a curative; and one or more ballistic stabilizers.

2. The composition according to claim 1, wherein the oxidizer comprises a nitramine.

3. The composition according to claim 2, wherein the nitramine is selected from the group consisting of cyclotrimethylenetrinitramine (RDX) and cyclotetramethylenetrinitramine (HMX).

4. The composition according to claim 1, wherein the lead salt is lead citrate.

5. The composition according to claim 4, comprising about 1.5 to about 3% by weight of lead citrate and about 60 to 63% by weight of the oxidizer.

6. The composition according to claim 1, wherein the plasticizer blend comprises nitrate esters selected from the group consisting of 1,2,4-butanetriol trinitrate (BTTN) and diethyleneglycol dinitrate (DEGDN).

7. The composition according to claim 1, wherein the binder comprises nitrocellulose.

8. The composition according to claim 1, comprising one or more stabilizers selected from the group consisting of N-methylnitroaniline (MNA), carbon and zirconium carbide.

9. The composition according to claim 1, wherein the curative is an isocyanate and is selected from the group consisting of hexamethylene diisocyanate (HMDI), isophorone diisocyanate (IPDI) and an aliphatic polyisocyanate resin based on HMDI.

10. A minimum smoke gas generating propellant comprising:

1,2,4-butanetriol trinitrate (BTTN);

diethyleneglycol dinitrate (DEGDN) in an amount between about 6.0% by weight to about 8.0% by weight;

nitrocellulose (NC) in an amount between about 3.5% by weight to about 4.5% by weight;

N-methylnitroaniline (MNA);

cyclotrimethylenetrinitramine (RDX);

lead citrate;

carbon;

zirconium carbide; and an aliphatic polyisocyanate resin based on hexamethylene diisocyanate (HMDI).

11. The composition according to claim 10, comprising about 17% by weight to about 20% by weight of BTTN.

12. The composition according to claim 10, comprising about 0.5% by weight to about 1.5% by weight of MNA.

13. The composition according to claim 12, comprising about 60% by weight to about 63% by weight of RDX.

14. The composition according to claim 13, comprising about 1.5% by weight to about 3.0% by weight of lead citrate.

15. The composition according to claim 14, comprising about 0.4% by weight to about 1% by weight of carbon.

16. The composition according to claim 15, comprising about 0.9% by weight to about 1.1% by weight of zirconium carbide.

17. The composition according to claim 16, comprising about 1.0% by weight to about 2.0% by weight of N-3200.

18. A method for propelling a projectile comprising the step of igniting a gas generating composition as in any one of claims 1–17, 6–7, 8–11 and 12–17.

19. A method for reducing the amount of smoke generated by nitramine containing propellant, which method comprises the step of formulating a propellant composition according to any one of claims 6–7, 8–11 and 12–17.

* * * * *